United States Patent [19]

Nivet

[11] 4,089,099

[45] May 16, 1978

[54] AUTOMATIC TOOL FOR SETTING RIVETS OR LIKE FASTENERS SUPPLIED IN STRIP FORM

[75] Inventor: André Nivet, Beauchamp, France

[73] Assignee: ITW de France, S.A., Beauchamp, France

[21] Appl. No.: 812,200

[22] Filed: Jul. 1, 1977

[30] Foreign Application Priority Data

Jul. 30, 1976 France ..... 76 23505

[51] Int. Cl.[2] ..... B23P 11/00

[52] U.S. Cl. ..... 29/243.53; 72/391

[58] Field of Search ..... 29/243.53; 72/391; 227/132

[56] References Cited

U.S. PATENT DOCUMENTS

| | | | |
|---|---|---|---|
| 4,010,630 | 3/1977 | Davis et al. | 72/391 |
| 4,027,520 | 6/1977 | Klein | 72/391 |

*Primary Examiner*—James L. Jones, Jr.

*Attorney, Agent, or Firm*—Jack R. Halvorsen; Robert W. Beart

[57] ABSTRACT

An automatic tool for rapidly setting rivets or like fasteners of the expansion type supplied in strip form. It comprises a magazine for receiving a strip of rivets in which the rivets can advance stepwise so that the leading rivet faces the outlet orifice. A breech movable longitudinally along the axis of the outlet orifice and provided with a barrel fitting over the rivet mandrel and over the rivet head so that the rivet is fetched into a setting position, well clear of the magazine, in order to enable same to be set visually. A striker sliding along the axis of the breech is provided with a pin which strikes the mandrel of the rivet through the barrel and drives it into the body of the rivet and causes the rivet to be secured in the assembly holes. A double-acting detent and trigger actuating mechanism is so devised that an initial phase of operation of the detent causes the breech to advance while a second phase of operation of the detent causes the striker to act.

5 Claims, 12 Drawing Figures

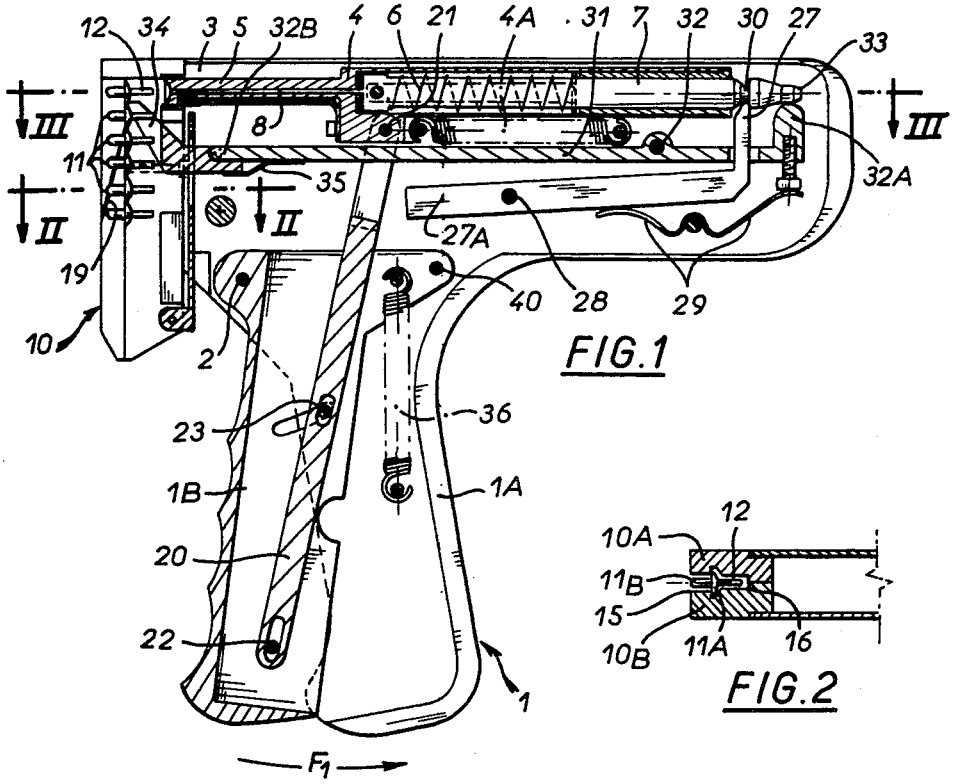
FIG.1
FIG.2
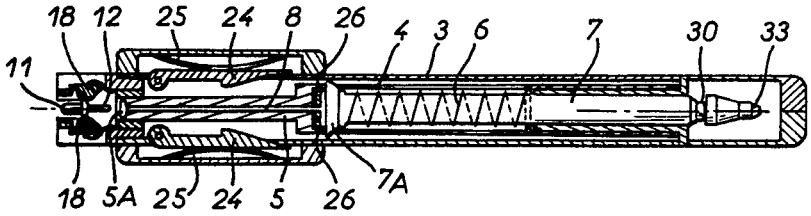
FIG.3
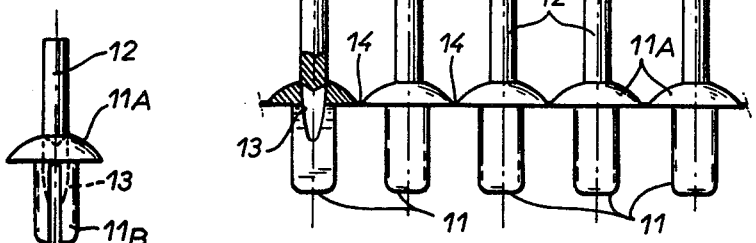
FIG.4
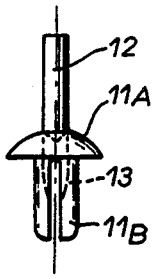
FIG.6
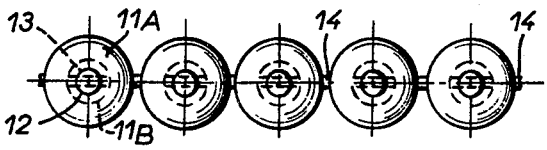
FIG.5

AUTOMATIC TOOL FOR SETTING RIVETS OR LIKE FASTENERS SUPPLIED IN STRIP FORM

The present invention relates generally to an improved automatic tool for rapidly setting rivets or like fasteners of the expansion type, used for example for joining sheet metal.

More particularly, plastic fasteners offer the advantage of being able to be supplied in the form of a strip bearing a multiplicity of fasteners which are joined together or fixed by means of glue or adhesive and which advance stepwise and are detached as they are being set.

Prior art pneumatic, mechanical or manual riveting machines all have disadvantages to a lesser or greater degree.

Pneumatically operated riveters, for instance, have the drawback of being heavy and bulky and of being dependent on a compressed-air station and, in many forms of application, on a vibrating bowl. They further require a fixed work station on the production line, which is an additional disadvantage. Lastly, a machine of this kind is very costly because of its highly complex construction.

Currently available automatic manual riveters have the following two major disadvantages:

Firstly, with such machines the riverts are usually positioned by a metallic locator, and this is moreover effected in the absence of any visibility, thereby frequently damaging the paintwork or the decorative surface of the items to be joined because of scratches or scoring caused by said locator. In addition, lateral or vertical spring effects frequently occur, thereby often jamming or damaging the rivets in the machine and causing loss of time and a loss of parts.

Secondly, such riveters in any event preclude efficient centering. For during the time interval which elapses between retraction of the locator and its place being taken by the rivet to be set, during which time no link exists between the riveting machine and the rivet hole, some perturbation and consequent out-of-true occurs in positioning of the rivet because of the operator's natural reactions to triggering of the mechanisms in the machine or because the surface into which the rivet is to be set may be sloping. As a result, the rivet to be set, being no longer guided, will either drop by itself into its lodging position or lace itself askew, thereby either jamming the machine or preventing the rivet from being correctly positioned.

The improved riveter according to this invention, which is of the automatic manually operated type, has none of the drawbacks of prior art riveting machines and permits rapid, effective and dependable setting of expansion-type rivets or like fasteners supplied in strip form. Such rivets are preferably of the type in which a mandrel or the like, integral with the body of the rivet, causes the stem of the rivet to expand once it has been inserted into the assembly holes.

A riveter according to this invention is characterized by the fact that it comprises:

a magazine for receiving a strip of rivets in which the rivets can advance stepwise so that the leading rivet positions itself between two rocking cams which hold it facing the outlet orifice;

a breech movable longitudinally along the axis of the outlet orifice of the magazine and provided at its front end with a barrel capable of fitting over the rivet mandrel and over the rivet head whereby, after the rivet has been separated from the next rivet on the strip and its supporting rocking cams have retracted, it is fetched into a setting position, well clear of the magazine, in order to enable it to be set visually;

a striker capable of sliding along the axis of the breach and provided with a front pin capable of striking the mandrel of the rivet through the barrel whereby to drive it into the body of the rivet and thereby cause the same to expand and to be rigidly secured in the assembly holes; and a double-acting detent and trigger actuating mechanism so devised that an initial phase of operation of the detent causes the breech to advance and to be locked in a position wherein the barrel protrudes in a position of external presentation of the rivet to be set, and that a second phase of operation of the detent triggers operation of the striker.

The description which follows with reference to the accompanying non-limitative exemplary drawings will give a clear understanding of how the invention can be carried into practice.

In the drawings:

FIG. 1 shows in longitudinal section and side elevation a tool for setting rivets or like fasteners supplied in strip form, in accordance with this invention, the tool being shown in the configuration in which it is loaded and ready for use;

FIG. 2 is a detail view in cross-section through the line II—II of FIG. 1, showing the portion of the magazine into which the strip of rivets is engaged;

FIG. 3 is a cross-section taken on the line III—III of FIG. 1;

FIGS. 4, 5 and 6 are detail side elevation, plan and end views, on an enlarged scale, of a set of rivets ready for loading the magazine;

Figure 7:
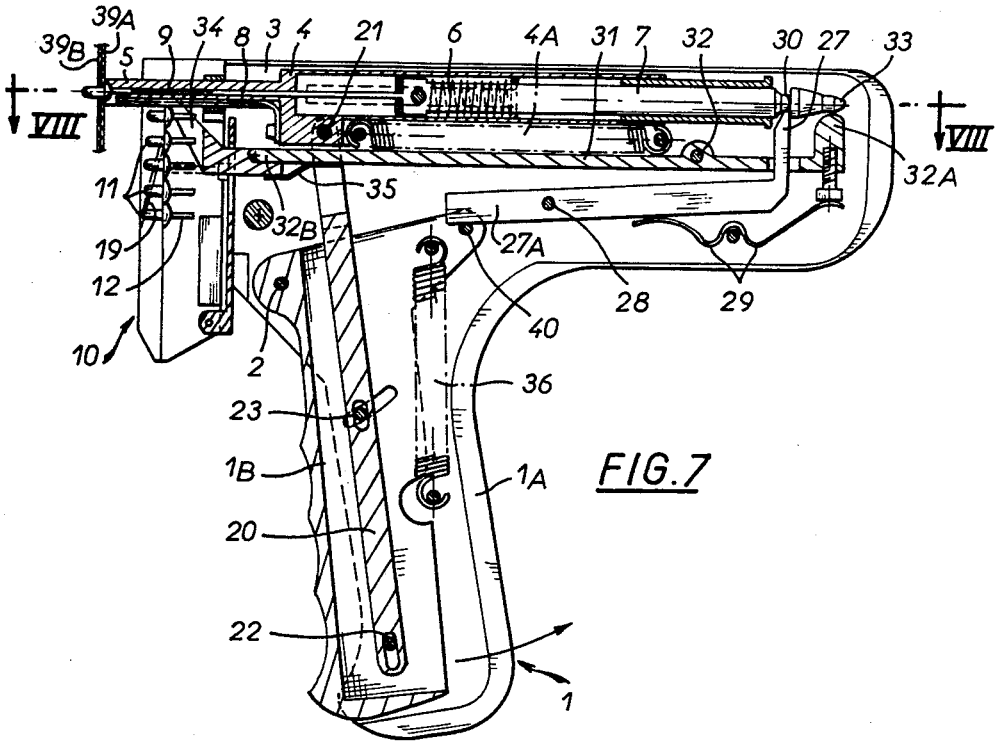
FIG. 7 is a view in side elevation and longitudinal section corresponding to FIG. 1, the tool being shown this time in the configuration it assumes after the user has operated its detent to bring it into its armed configuration.

The tool illustrated by way of example in the drawings takes the general form of a gun the butt or handle 1 of which comprises a portion $\mathbf{1}_A$ fast with the body proper and a movable portion $\mathbf{1}_B$ pivotally mounted on a pin 2 and forming the tool actuating member or detent, as will be described in greater detail hereinafter.

Provided at the top of the body is a housing generally designated by reference numeral 3, inside which is longitudinally slidable a breech 4 the forward end of which is extended by a barrel 5, the function of which will be explained in greater detail hereinbelow. Slidable through breech 4, responsively to a spring 6, is a striker 7 bearing at its front end a pin 8 which is a sliding fit inside an axial passage 9 formed through barrel 5 and which is more clearly shown on FIGS. 7, 8, 9 and 10.

Fixable to the front part of housing 3 is a magazine, generally designated by reference numeral 10, which can be supplied with a strip of rivets or the like 11, as shown by way of example in FIGS. 4, 5 and 6. Each rivet is of the type having a head $11_A$ and a stem $11_B$ capable of being expanded when a mandrel 12 integral with the body is forcibly driven into an orifice 13 formed in the rivet head. Such rivets are preferably plastic mouldings and are united to form a continuous strip by means of small fasteners 14 which are sectioned as each leding rivet is set, as will be explained in detail hereinafter.

Manifestly, this type of rivet is given by way of example only, and a tool according to this invention will permit of setting other types of fasteners having an expanding mandrel.

As shown in FIG. 2, magazine 10 is formed by two lateral guides $10_A$ and $10_B$ which provide two flanges along which the rivet heads $11_A$ are slidable as the rivet stems $11_B$ slide through a forward longitudinal slot 15 and the rivet mandrels 12 through a rear longitudinal slot 16. The portion of magazine 10 facing barrel 5 enlarges into an outwardly opening chamber 17 provided laterally with two rocking cams 18 the function of which is to restrain the head of the rivet arriving opposite barrel 5 and to constrain mandrel 12 to slide into passage 9. Non-return catches 19 are provided in the magazine for the purpose of holding the strip of rivets in place inside the magazine by preventing it from moving back when the magazine is being loaded.

Breech 4 and its barrel 5 are moved by a link 20 having its upper end hinged about a pin 21 fast with the breech and its lower end about a pin 22 fast with the movable portion $1_B$ of the butt. Link 20 pivots about a pin 23 fast with the fixed portion $1_A$ of the butt. Obviously, suitable slots are provided to compensate for the differences in centre distance that occur by reason of the fact that breech 4 moves in a straight line whereas link 20 pivots.

As will be explained in greater detail hereinafter, breech 4 is locked in the front position by latches 24 which, responsively to return springs 25, engage with keepers 26 with which the breech is provided.

Striker 7 and its pin 8 are locked in position independently of movement of breech 4, by means of trigger 27 which is pivotally mounted about a pin 28 and which an arm of a return spring 29 is effective in engaging into a groove 30 formed on the striker.

Means are provided for automatically advancing the rivets in magazine 10, which means are formed by a lever 31 fulcrumed about a pin 32, the rear end $32_A$ of which is urged by the second arm of return spring 29 against a camming surface 33 formed on striker 7 and the front end $32_B$ of which is provided with a rocking clevis 34 associated to a return spring 35.

The manner of operation of the subject tool of this invention will now be described, starting from the initial configuration shown in FIGS. 1, 2 and 3 in which magazine 10 is appropriately fed with a strip of rivets 11.

If the user now exerts pressure on the moving portion $1_B$ of the butt, it will pivot about pin 2 in the direction of arrow $F_1$ against the countering force of spring 36. This pivotal motion of trigger $1_B$ causes breech 4 to be moved against the countering force of spring $4_A$ by the link 20 pivoting about pin 23 responsively to driving pin 22, and forward motion of the breech 4 continues until it is locked through latches 24 engaging with keepers 26. Thereafter, trigger $1_B$ can no longer move back.

Forward motion of breech 4 causes, firstly, compression of spring 6 of the striker 7, which is thereupon locked by trigger 27, and secondly (as more clearly shown in FIGS. 7, 8 and 9) forward motion of barrel 5, the front end of which is provided with a cup $5_A$ which engages over the head $11_A$ of the leading rivet in magazine 10, at the same time as the mandrel 12 of that rivet is clamped within passage 9 by an elastic member 27 projecting thereinto.

It is to be noted that as barrel 5 advances, the leading rivet is detached from the strip by the cutting action of the barrel end $5_A$ specially machined for the purpose, and that simultaneously the rocking cams 18 which up to then held the rivet after having constrained the mandrel to penetrate into passage 9 are spread apart by the front end of barrel 5 penetrating therebetween.

The rivet is accordingly presented externally of the tool, being supported by the barrel, the end of which likewise projects from the tool forward of the magazine, say over a distance in excess of 20mm.

This particularity gives the subject tool of this invention an important advantage over prior art riveters.

Since the user enjoys an unobstructed view of the rivet to be set, he can then readily insert it into one of the holes 38 in metal sheets $39_A$ and $39_B$ to be joined together. Further, because the rivet mandrel 12 is securely held in passage 9 by elastic member 37 and since the outer diameter of barrel 5 is preferably not greater than that of the rivet head, the user can readily insert the rivet into holes in horizontal, vertical or sloping steel sheets, or even along angled surfaces or into recesses, as shown by way of example in FIGS. 9 and 10, this being entirely out of the question with prior art riveters.

Figure 8:
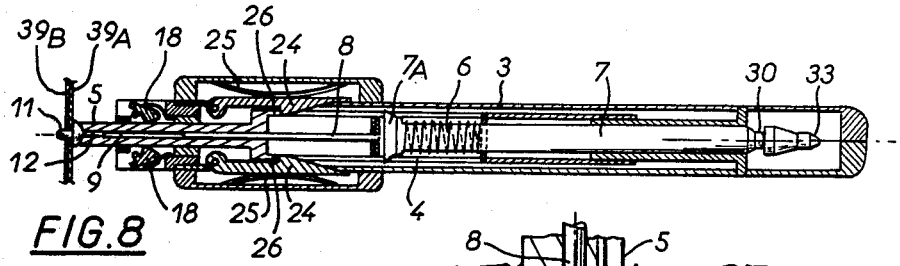
FIG. 8 is a cross-sectional view on the line VIII—VIII of FIG. 7.
Figure 9:
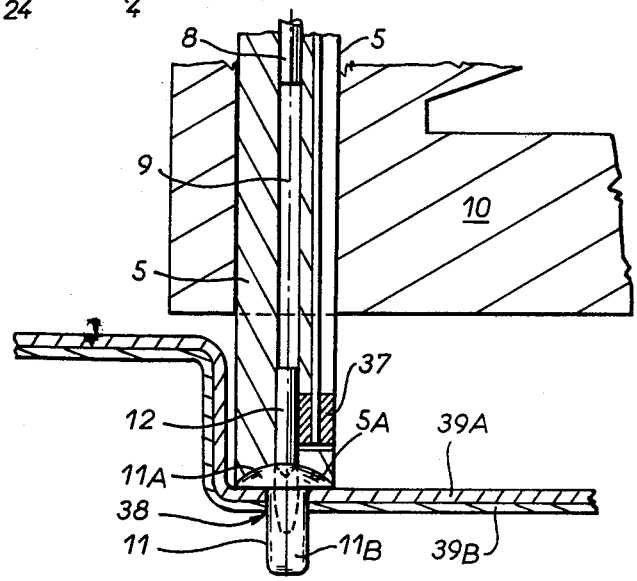
FIGS. 9 and 10 are explanatory diagrams, on an enlarged scale, showing the end of the barrel bearing the rivet to be set and how it is possible to set the rivet respectively flush with an angled surface or into the bottom of a recess.

The various moving parts of the tool will then be in the relative positions shown in FIGS. 7 and 8 and will be locked therein for as long as the user needs to correctly position the rivet in the holes in sheets $39_A$ and $39_B$.

After he has inserted the rivet into the rivet holes (see FIGS. 7 and 8), the user exerts a second pressure on the detent $1_B$, again in the direction of arrow $F_1$ and against the countering force of return spring 36.

Figure 11:
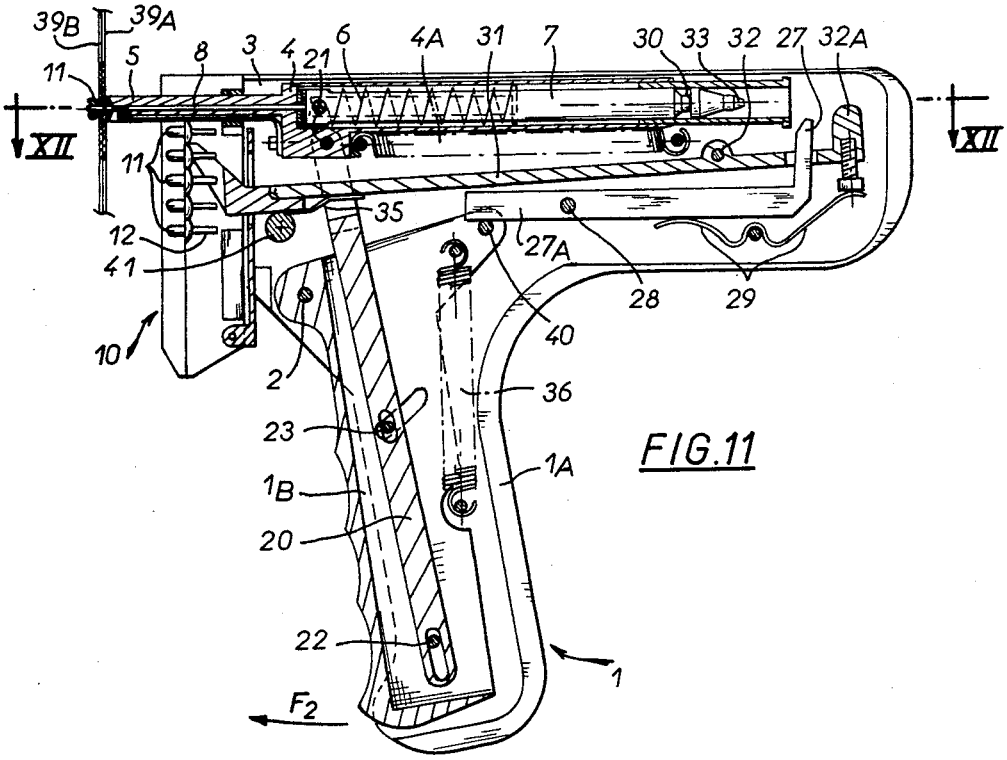
FIG. 11 is a side elevation view in longitudinal section corresponding to FIGS. 1 and 7, the tool being shown this time in the configuration it assumes after the user has operated the detent a second time in order to definitively secure the rivet into the holes in the metal sheets to be joined.
Figure 12:
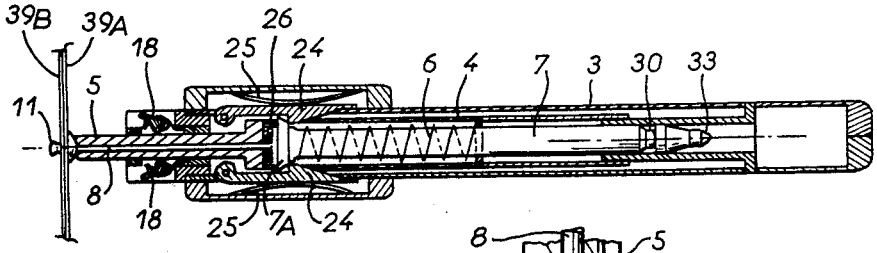
FIG. 12 is a cross-sectional view on the line XII—XII of FIG. 11.
Figure 10:
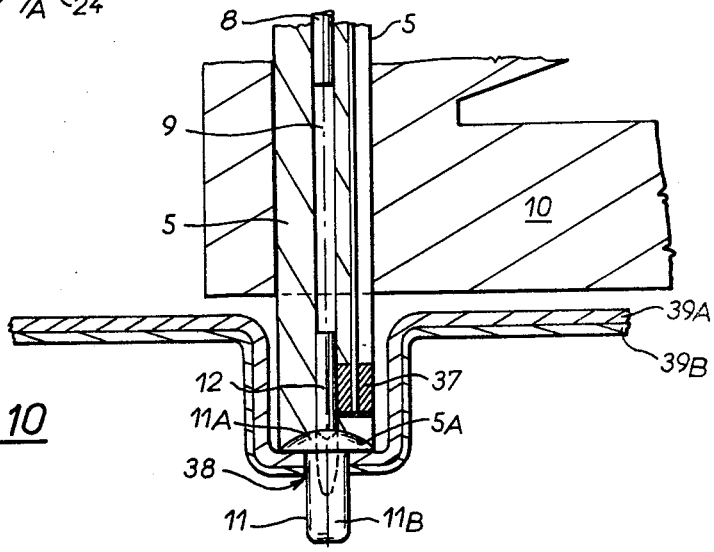

This further pressure on the detent (see FIGS. 11 and 12) causes a stub 40 provided on movable portion $1_B$ to contact the front end $27_A$ of the lever fulcrumed at 28 and the rear end of which forms trigger 27. As the detent pursues its motion against spring 29, trigger 27 pivots about pin 28 and disengages from the groove 30 in striker 7. Responsively to spring 6, striker 7 is then propelled forward and its striker pin 8 strikes mandrel 12 and drives it into the stem of the rivet whereby to expand it and definitively secure it inside the rivet holes in sheets $39_A$ and $39_B$.

Simultaneously the end $32_A$ of the feed arm 31 with its rocking clevis 34 disengages from cam 33 fast with striker 7. Feed arm 31 then pivots about pin 32 responsively to spring 29 and retracts into contact with adjustable stop 41. The effect of this is to cause clevis 34 to rock over the head of the rivet which follows the one just set and to position itself behind said head.

During retraction of clevis 34, the non-return catches 19 on rivets 11 hold the strip in position and prevent it from moving back.

After a rivet has been set, the tool is freed and the user can allow it to rearm itself automatically by relaxing the pressure on detent $1_B$. As will readily be appreciated, springs 36 and $4_A$ return the compound formed by breech 4, striker 7 and detent 1 into their initial positions shown in FIGS. 1 and 2. During retraction of striker 7, the cam $7_A$ with which it is provided proximate the percussion end of striker pin 8 spreads apart the latches 24 in order to prevent accidental locking of breech 4 upon retraction thereof.

At the end of the return stroke, cam 33 thrusts away the head $32_A$ of feed arm 31 which, by pivoting about pin 32, causes the strip of rivets 11 to advance and positions a fresh rivet between rocking cams 18 ready for a further operating cycle.

A release lever is provided in order to enable nonreturn catches 19 to be retracted if necessary to enable the strip of rivets to be extracted from magazine 10.

It goes without saying that many changes and substitutions of parts may be made in the preferred embodiments described hereinabove, without departing from the scope of the invention as set forth in the appended claims.

I claim:

1. An automatic portable tool for setting and fixing rivets or like fasteners of the expansion type supplied in strip form, inside assembly holes, comprising:

a magazine formed by a slideway for receiving a strip of rivets; an outlet orifice having supporting rocking cams disposed therein; and means for advancing the strip of rivets stepwise whereby to fetch the leading rivet between said supporting rocking cams in the outlet orifice;

a breech movable longitudinally along the axis of said magazine outlet orifice and provided at its front end with a barrel, said barrel being capable of engaging with the rivet mandrel and with the rivet head whereby to fetch the rivet, after its attachment means to the next rivet have been cut and said supporting rocking arms have retracted, into a presentation position wherein it stands well proud of the magazine and can be set visually;

a striker slidable along the axis of said breech and having a front striker pin, said pin being capable of striking the rivet mandrel through said barrel whereby to drive it into the body of the rivet and cause the same to be secured by expansion inside the assembly hole;

and a double-acting detent and trigger actuating mechanism so devised that, responsively to an initial pressure on the detent, it causes said breech to advance and to be locked in a configuration wherein said barrel projects in a position of external presentation of the rivet to be set and, responsively to a second pressure on the detent, it triggers operation of said striker.

2. A tool as claimed in claim 1, in which the end of said barrel has an axial passage therethrough which forms both a receptacle for the rivet mandrel, inside which the same is maintained by an elastic member, and a passageway for the striker pin of the striker, said barrel end further having a cup which engages over the rivet head and is machined so as to have a peripheral cutting action.

3. A tool as claimed in claim 2, in which the outer diameter of the barrel is substantially equal to that of the rivet head, whereby it is possible to insert the rivet into recesses having a diameter substantially equal to that of the rivet.

4. A tool as claimed in claim 1, in which the magazine includes retractable non-return catches to permit proper positioning of the leading rivet between said supporting rocking cams.

5. A tool as claimed in claim 1, including elastic return means which, upon the detent being released after the second pressure exerted thereon, cause a return of the moving members of the tool into their initial rearmed positions and activate the means for advancing the strip of rivets stepwise through the magazine.

* * * * *